US006789853B2

(12) United States Patent
Fewchuk

(10) Patent No.: US 6,789,853 B2
(45) Date of Patent: Sep. 14, 2004

(54) PIVOTAL MOUNTING MECHANSIM

(75) Inventor: Michael Andrew Fewchuk, Eastwood (AU)

(73) Assignee: Sebel Furniture Limited, New South Wales (AU)

( * ) Notice: Subject to any disclaimer, the term of this patent is extended or adjusted under 35 U.S.C. 154(b) by 0 days.

(21) Appl. No.: 10/336,144

(22) Filed: Jan. 3, 2003

(65) Prior Publication Data

US 2003/0189368 A1 Oct. 9, 2003

(30) Foreign Application Priority Data

Apr. 5, 2002 (AU) ..... PS1578

(51) Int. Cl.[7] ..... B47C 31/00; B60N 2/44

(52) U.S. Cl. ..... 297/463.1; 403/194; 403/326; 403/329; 297/463.2

(58) Field of Search ..... 297/463.1, 463.2; 403/167, 168, 326, 329, 384, 397, 194, 230, 233; 248/219.2

(56) References Cited

U.S. PATENT DOCUMENTS

| | | | | |
|---|---|---|---|---|
| 2,620,858 A | * | 12/1952 | Hoven et al. | 297/463.1 |
| 3,471,186 A | * | 10/1969 | Geen et al. | 403/326 |
| 5,069,573 A | * | 12/1991 | Blake et al. | 403/233 |
| 5,927,813 A | * | 7/1999 | Nemoto | 297/463.1 |
| 6,292,979 B1 | * | 9/2001 | Kuo | 403/326 |

* cited by examiner

*Primary Examiner*—Anthony D. Barfield
(74) *Attorney, Agent, or Firm*—Bell, Boyd & Lloyd LLC

(57) ABSTRACT

A pivotal mounting mechanism and a method of mounting an axle in an axle mount. A plug is inserted in a receptacle such as the open end of a tube which has at least one J-shaped track. The axle is held in its final position by inter-engagement of the plug and tube. The mounting mechanism is easily assembled and substantially vandal resistant.

13 Claims, 8 Drawing Sheets

PIVOTAL MOUNTING MECHANSIM

BACKGROUND OF THE INVENTION

The present invention relates to pivotal mounting mechanisms which find particular application in the production of furniture such as chairs with pivotal seats and tables with pivotal legs. In particular, an axle mount arrangement and a method of mounting an axle in an axle mount are disclosed.

In the furniture field, in order to provide a pivotal mount, a cylindrical steel axle is normally provided which forms the basis of the pivoting mechanism. In one type of stadium seating, a substantially vertical backrest is provided together with a pivotal seat which is movable between a substantially horizontal use position and a substantially vertical storage position. This enables close row spacing combined with adequate access. Such stadium seating is normally mounted on a rigid spine which extends along the tread of a stepped or tiered arrangement with the spine of each tread constituting a foundation for a corresponding row of seats.

The overall cost of the provision of stadium seating is determined by three major cost factors. The first factor is the production cost of the physical items which go to make up the seating, such as the backrest, seat, spine, pivotal mechanism, and the like. The second cost factor is the transport of the physical items to the site. The third major cost factor is the labor cost of installing at the site of the stadium, the prefabricated seating components. This installation procedure must be carried out for each seat of the stadium and, particularly in countries where labor costs are high, represents a substantial proportion of the financial value of the seating contract for the stadium.

SUMMARY OF THE INVENTION

It is therefore an advantage of the present invention to provide an axle mount arrangement and a method of mounting an axle in an axle mount, which permit stadium seating to be quickly and easily installed.

The invention is also applicable to other types of furniture, such as tables with pivotal legs, where again a reduction in assembly time is advantageous leading to a lower overall cost of production.

In accordance with a first aspect of the present invention there is disclosed an axle mount arrangement for furniture, said arrangement comprising a receptacle having at least one side wall, having a rim, at least one curved track formed in said side wall and commencing at said rim, said track being dimensioned to receive the axle to be mounted, and a plug dimensioned to be received in said receptacle, said plug having an axle receiving aperture therein shaped to define a first and a second axle niche which are spaced apart by a distance corresponding to the displacement of said curved track, whereby said axle can be positioned in said fist axle niche and said plug introduced into said receptacle to thereby align said axle and the start of said curved track, and whereby as said plug is fully inserted into said receptacle said axle moves along said track from said first to said second niche, and is held in said second niche by inter-engagement of said plug and receptacle.

In accordance with a second aspect of the present invention there is disclosed A method of mounting an axle in an axle mount, said method comprising the steps of:

(i) positioning said axle in a first axle niche of an axle receiving aperture of a plug, (ii) introducing said plug into a receptacle having at least one side wall which has a rim, said receptacle having at least one curved track formed therein and commencing at said rim, said track being dimensioned to receive said axle, and (iii) fully inserting said plug into said receptacle to thereby move said axle along said track and also displace said axle from said first axle niche into a second axle niche within said axle receiving aperture, whereby said axle is held in said second niche by inter-engagement of said plug and receptacle.

In accordance with a third aspect of the present invention there is disclosed a article of furniture having at least one part thereof pivotal with respect to the remainder of the article about an axle, wherein the axle is mounted in the above-mentioned axle mount arrangement or is mounted by the above-mentioned method of mounting an axle.

Additional features and advantages of the present invention are described in, and will be apparent from, the following Detailed Description of the Invention and the figures.

BRIEF DESCRIPTION OF THE DRAWINGS

Two embodiments of the present invention will now be described with reference to the drawings in which.

DETAILED DESCRIPTION

Figure 1:
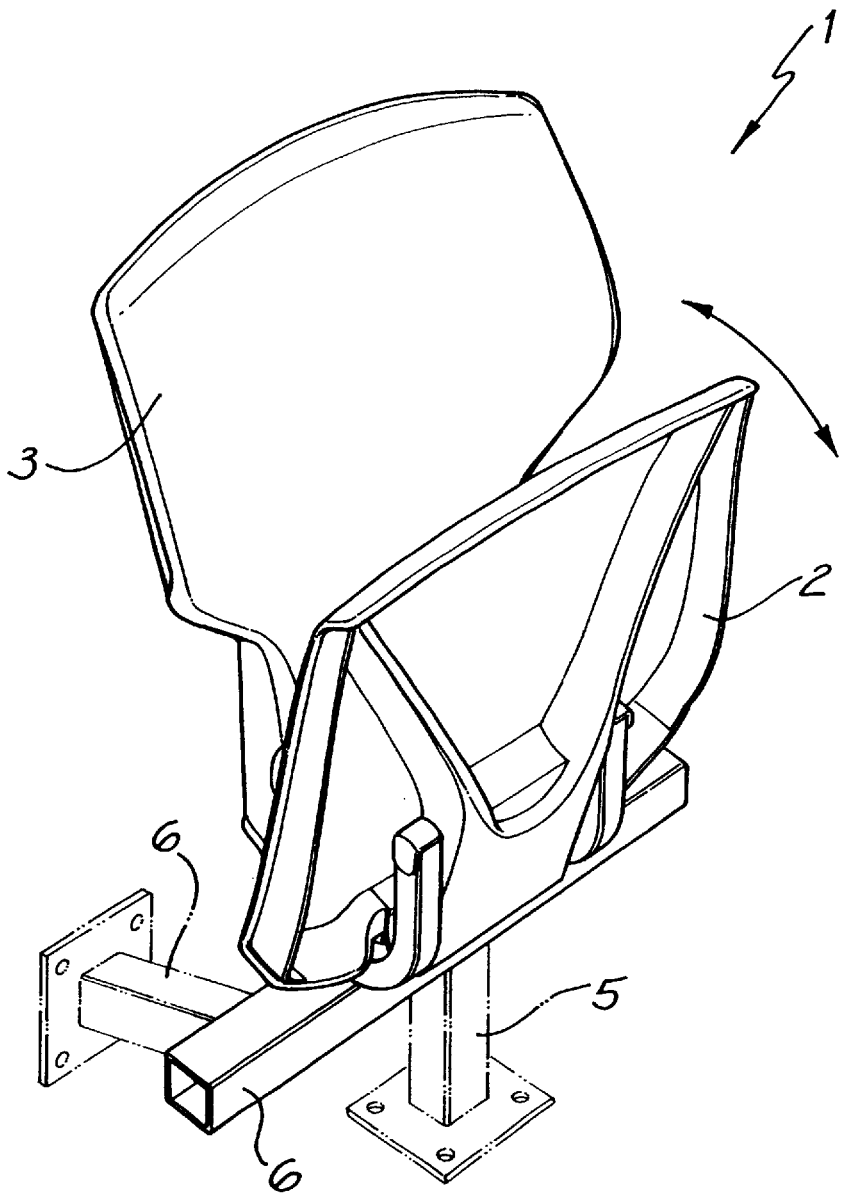
FIG. 1 is a perspective view of stadium chair showing the seat in the non-use position.

As seen in FIG. 1, a stadium chair 1 has a seat 2 and a backrest 3. In normal parlance the term stadium seat would be used instead of stadium chair, however, in order to distinguish between the seat as a whole and the pivoted seat 2, the term "stadium chair" will be used herein.

The stadium chair 1 is mounted on a spine 4 which, as indicated by dashed lines in FIG. 1, can be mounted in conventional fashion either by means of a vertical support 5 which is secured to a tread, or a horizontal support 6 which is secured to a riser. Such support arrangements for the spine 4 are entirely conventional. Also conventional are dual spine arrangements (not illustrated).

Figure 2:
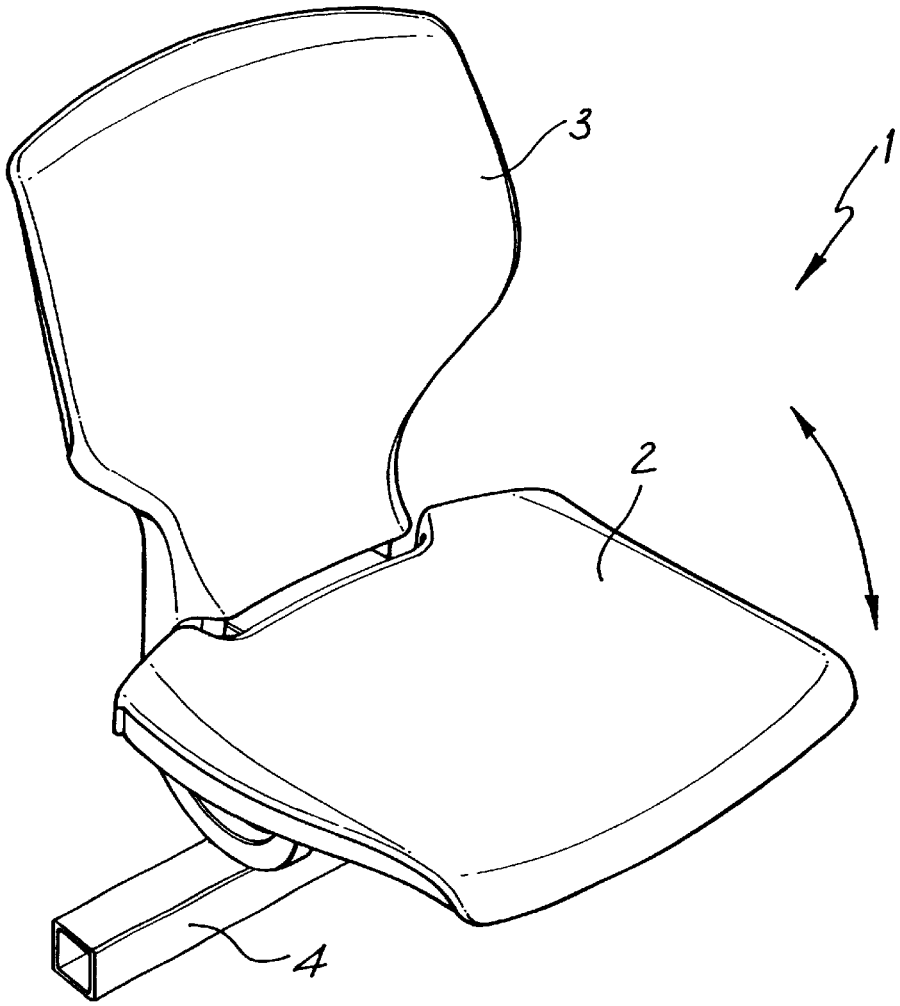
FIG. 2 is a perspective view showing the stadium chair with the seat in the use position.

The stadium chair 1 with the seat 2 in its use position is illustrated in FIG. 2 and the seat 2 is able to be pivoted between the non-use position illustrated in FIG. 1 and the use position illustrated in FIG. 2 as indicated by the arrows in those drawings.

Figure 3:
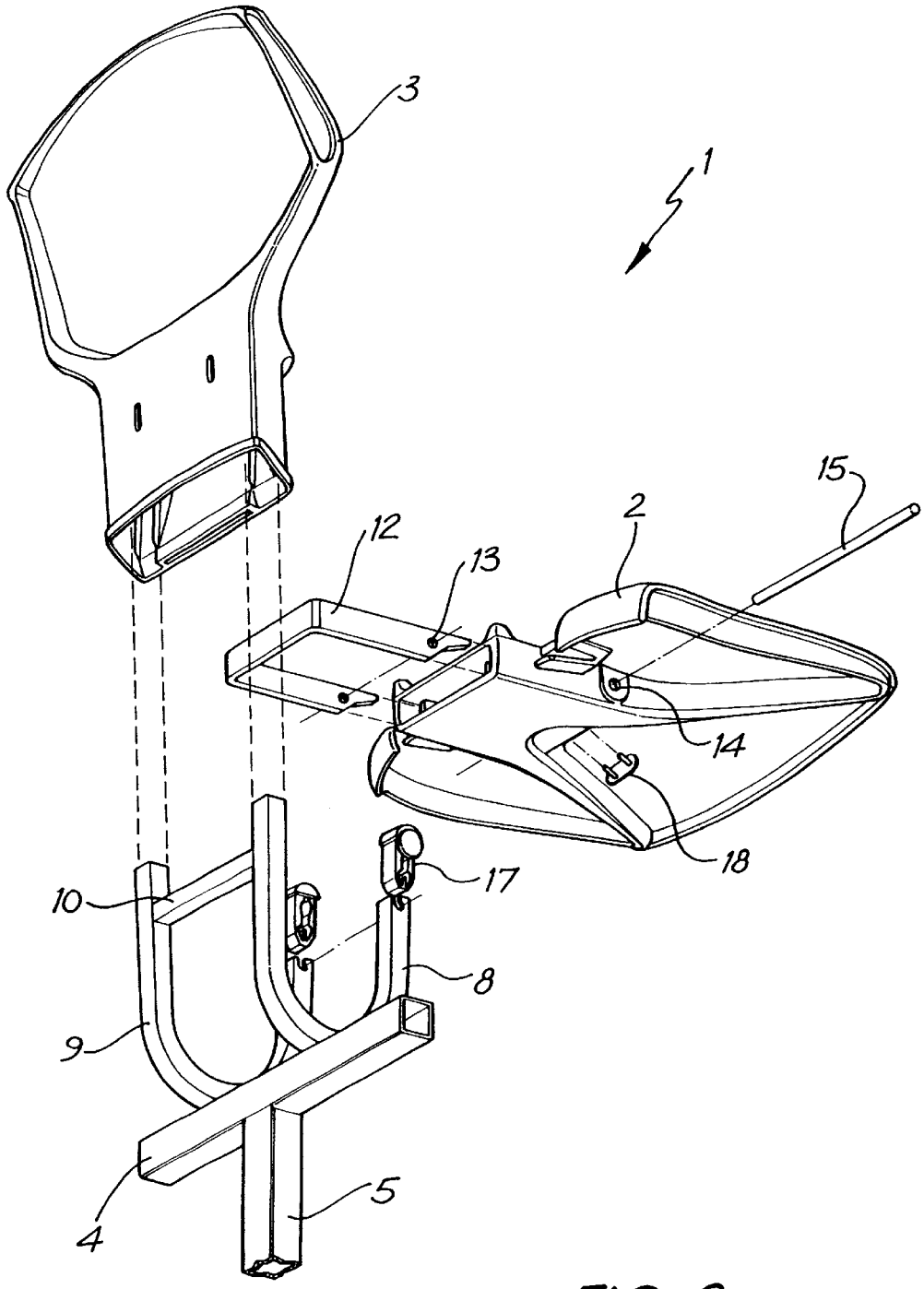
FIG. 3 is an exploded perspective view of the stadium chair.

Turning now to FIG. 3, it will be seen that welded, or otherwise secured, to the spine 4 are a pair of support tubes 8, 9 which are preferably formed from hollow square steel stock. A cross brace 10 extends between the tubes 8, 9 and forms part of a substantially conventionally mounting arrangement for the backrest 3. The backrest 3 is moulded with two interior ramps which enables the backrest to be vertically pushed onto the support tubes 8, 9 and for the ramps to snap engage with the cross brace 10. In this way the backrest 3 is securely fastened to the support tubes 8, 9.

Also illustrated in FIG. 3 is the detail of the seat pivot. It will be seen that the seat 2 is provided with a hollow interior which receives a U-shaped yoke 12 having two pivot apertures 13. The seat 2 also includes a pair of apertures 14 through which an axle 15 passes. In addition, as it will become clear hereafter, the axle 15 also passes through the ends of the support tubes 8, 9 and through two plugs 17. If desired, a seat number indicator 18 which snap engages with the seat 2, can be provided.

Figure 4:
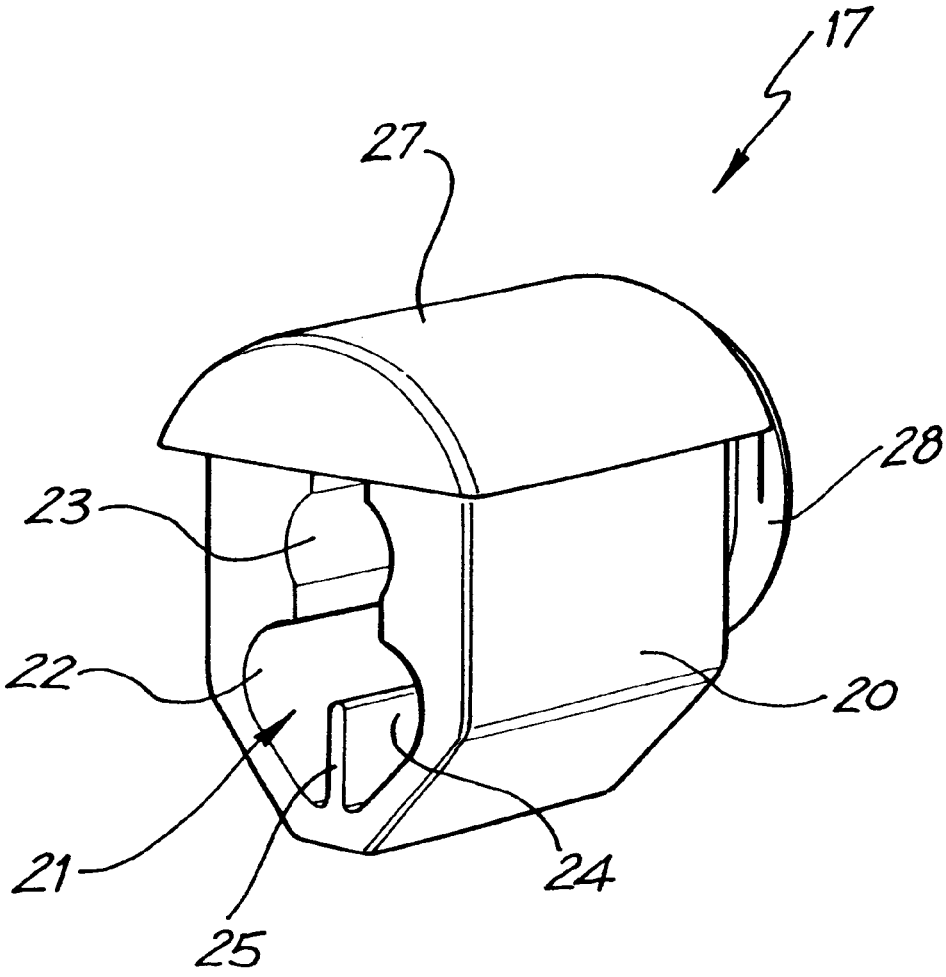
FIG. 4 is a perspective view of the plug used in the axle mount arrangement.
Figure 5:
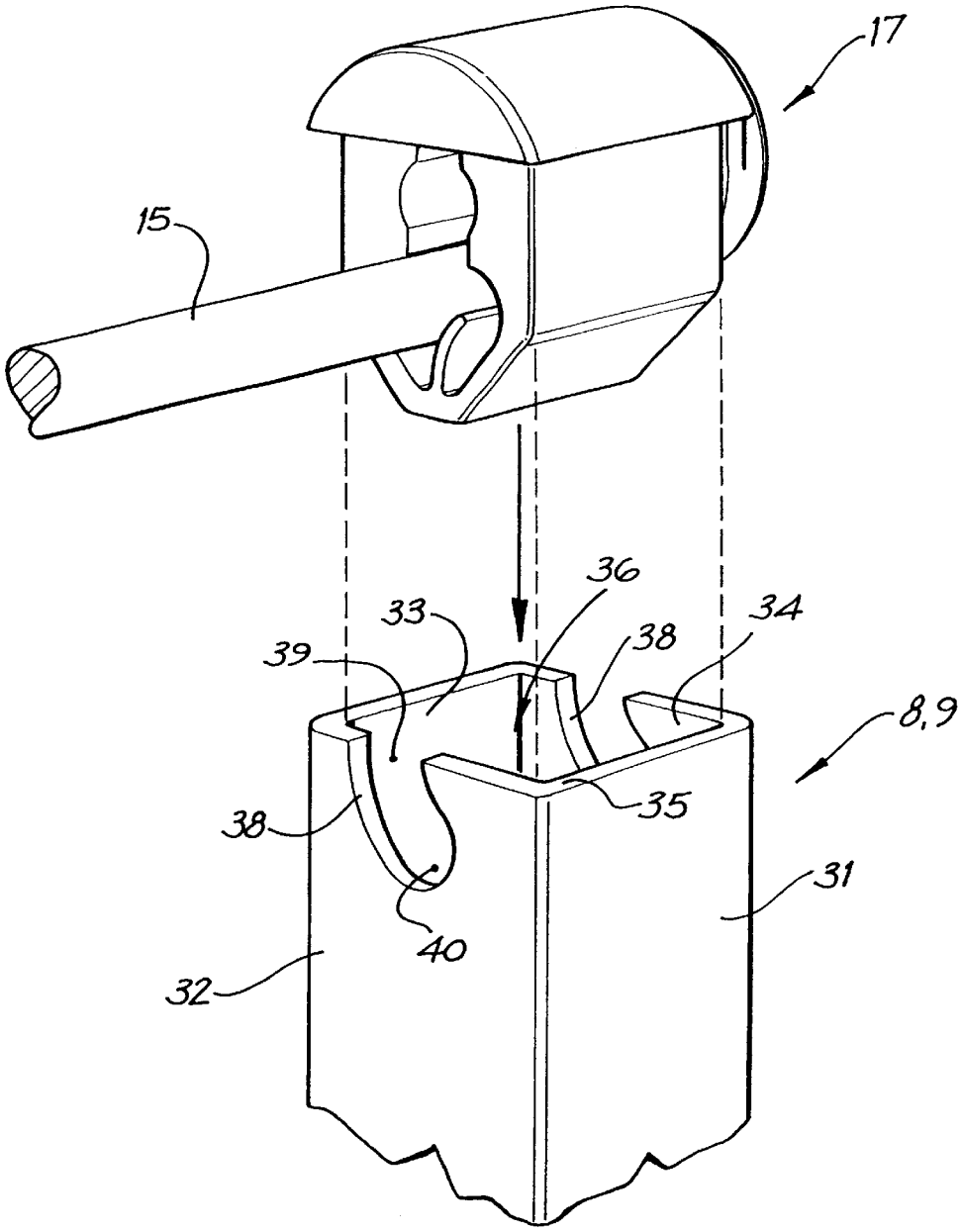
FIG. 5 is a an exploded perspective view of the plug, axle and mounting tube or receptacle showing the axle in its first niche position.
Figure 6:
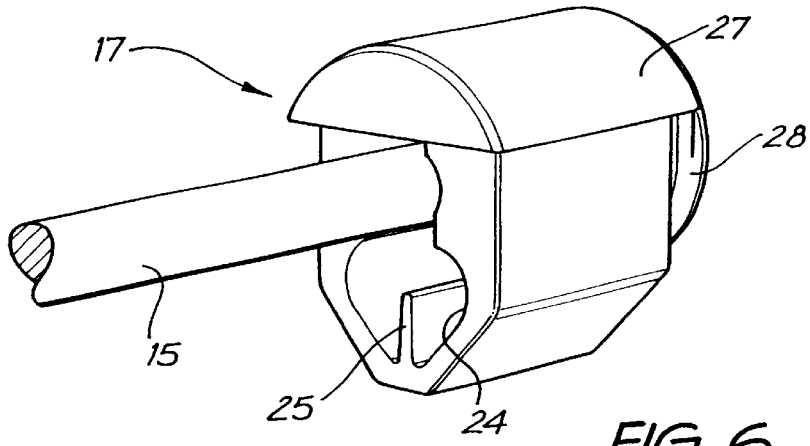
FIG. 6 is a perspective view of the plug showing the axle in its second niche position.

Turning now to FIGS. 4 and 5, each of the plugs 17 has a central body 20 of substantially square cross section through which extends an axle receiving aperture 21. Located within the lower portion of the aperture 21 and to the left hand side as seen in FIG. 4 is a first axle niche 22. Located in the upper portion of the axle receiving aperture 21 is a second axle niche 23 and located in the lower part of the axle receiving aperture 21, and to the right hand side as seen in FIG. 4, is a third axle niche 24. Located in between the first and third niches 22, 24 is a resilient flap 25.

The plug 17 as seen in FIG. 4 also has a cap 27 and a side flap 28 which obscures at least the second axle niche 23 when the plug 17 is viewed in the opposite direction from that illustrated in FIG. 4.

As seen in FIG. 5, the support tubes 8, 9 are each formed from hollow metal tubing having a constant cross section which is rectangular and, preferably, square as illustrated in FIG. 5. The tubes 8, 9 have four side walls 31–34 the upper edges of which define a rim 35 for the receptacle 36 formed by the open end of the tube 8, 9. In addition, the side walls 32, 34 each have a corresponding curved J-shaped track 38. Each track 38 has an opening 39 and an end 40.

Figure 12:
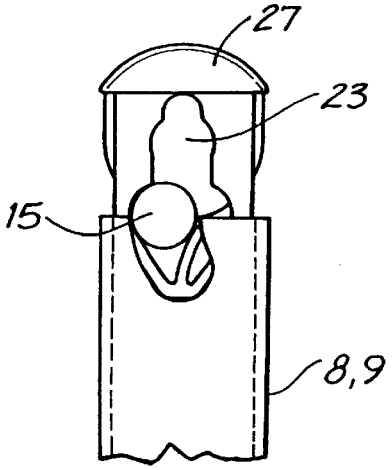
FIG. 12 is a side elevational view showing the axle carrying plug initially inserted into the mounting tube.

Turning now to FIGS. 6–13, the method of mounting the axle 15 will now be described. First, a plug 17 is placed on each end of the axle 15 so as to insert the axle 15 into the first axle niche 22. This deflects the resilient flap 25 as seen in FIG. 5 which therefore holds the plug 17 and axle 15 so assembled. As indicated in FIG. 12, the central body 20 of the plug 17 is then initially inserted into the open end of the support tube 8, 9. The first axle niche 22, central body 20 and opening 39 of track 38 are so dimensioned that the axle 15 at this juncture is introduced into the opening 39 of the track 38.

Figure 13:
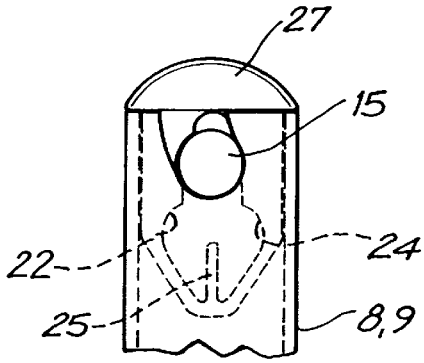
FIG. 13 is a view showing the axle carrying plug in its final position.

Continued insertion of the plug 17 into the open end of the support tube 8, 9 results in two movements taking place simultaneously. Firstly, the axle 15 is moved along the track 38 until it reaches its end 40. Simultaneously, the axle 15 is also moved from the first axle niche to the second axle niche 23 as seen in FIG. 13.

Figure 7:
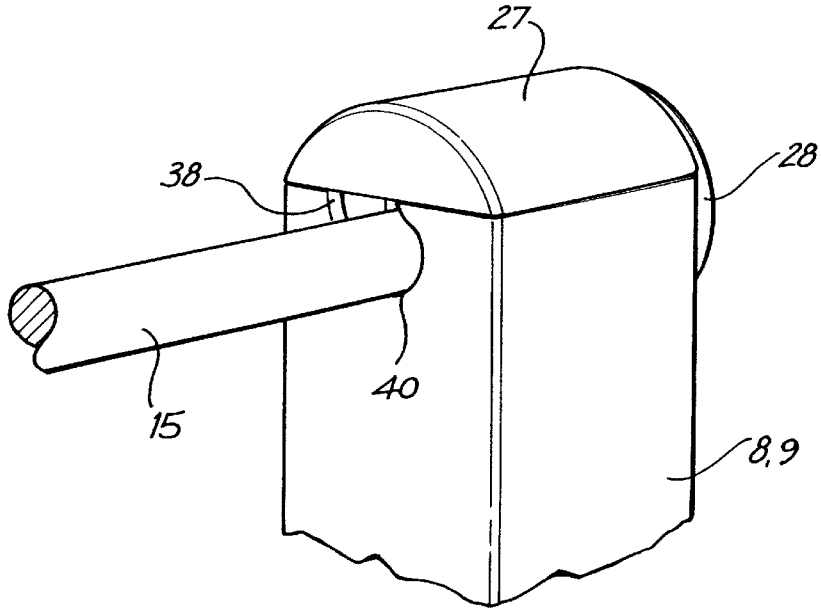
FIG. 7 is a perspective view showing the mounting tube with the axle in its final position.
Figure 8:
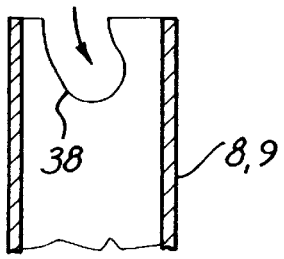
FIG. 8 is a cross-sectional view showing one of the two tracks formed in the end of the mounting tube.
Figure 9:
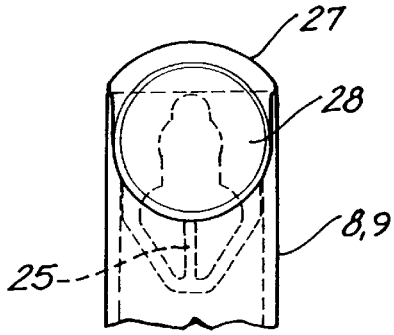
FIG. 9 is a side view showing the plug inserted in the mounting tube without the axle being present.
Figure 10:
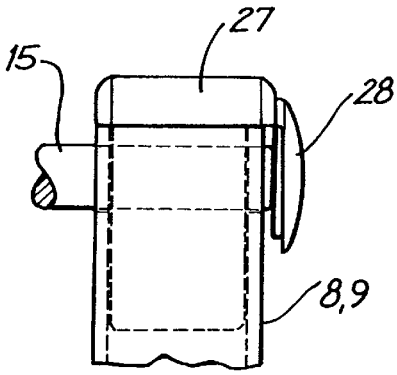
FIG. 10 is a side view illustrating the axle in its final mounted position.
Figure 11:
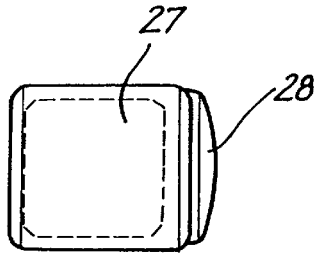
FIG. 11 is a plan view showing the plug in relation to the mounting tube.

From FIGS. 7 and 10 it will seen that the axle 15 is held at the end 40 and thus the side flap 28 covers the free end of the axle 15. Furthermore, the cap 27 abuts the rim 35 when the plug 17 is fully inserted into the receptacle 36.

A number of very desirable features arise from the above described embodiment. Firstly, the plug 17 is dual handed in that the same moulding and plug can be used for each end of the axle 15. For one end of the axle 15 the axle is initially retained in the first axle niche 22 whilst for the other end of the axle 15 the axle is initially retained in the third axle niche 24.

Secondly, the side flap 28 prevents direct access to the corresponding end of the axle 15. This blocks longitudinal movement of the axle 15 towards the side flap 28, especially prior to assembly.

Thirdly, as the side flap 28 obscures the free end of the axle 15, this contributes to making the whole arrangement substantially vandal resistant. In particular, as the plug 17 is only able to move vertically within the tube 8, 9, the plug 17 is unable to be manually extracted from the tube end without first destroying the side flap 28 and forcing the axle 15 in the direction of its longitudinal axis out of the tube 8, 9. As a consequence, the stadium seating is particularly invulnerable to attacks by vandals, dissatisfied sports fans, and the like. Whilst the plug 17 may be able to be vertically forced with a specially designed tool, these are not generally available to would-be vandals.

Furthermore, the dimensional tolerance able to be achieved with plastic moulding and cutting of the tracks 38 means that two types of axle mounting are able to achieved. In the first type the axle 15 is securely held against rotation and is held in the end 40 and the second axle niche 23 and thus represents a solid or immovable axle. Alternatively, in the second type the dimensions are relaxed and thus the axle 15 is able to rotate in the ends 40 and second axle niche 23, if desired.

With the first mentioned arrangement of a rigid axle 15, the pivot apertures 13 in the yoke 12 can be made relatively loose, as can the apertures 14 in seat 2 so that an easy pivotal motion of the seat 2 arises.

Furthermore, a very easy assembly of the stadium seat 2 is the result. With reference to FIG. 3, the seat 2 is assembled with the yoke 12 inserted into the seat, the axle 15 inserted through the apertures 13 and 14, and a plug 17 is placed on each end of the axle 15. In this assembled condition the seat 2 is able to be transported to the stadium site without the plugs 17 becoming dislodged from the axle 15. Thereafter the seat 2 is able to be mounted on the support tubes 8, 9 simply by providing a sufficient downwardly directed force on the plugs 17 so as to carry out the above described action.

This represents a substantial saving in labor time over prior art practices. If necessary, a tool can be used having one end to engage the bight of the yoke 12. The other end of the tool is engaged by the foot of the installer so as to exert a sufficient downward pressure on the yoke 12 and thus the plugs 17 to ensure their complete insertion.

Figure 14:
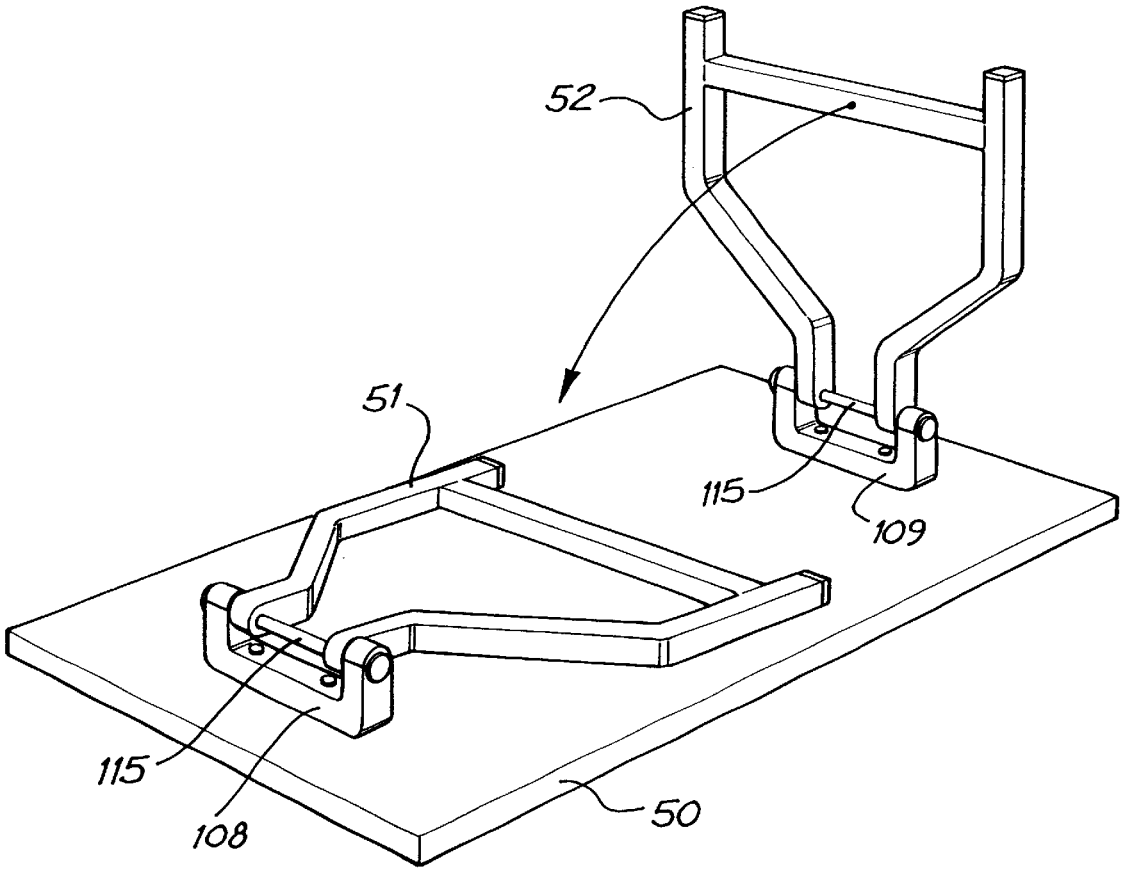
FIG. 14 is a schematic perspective view of a table having pivotal legs.

Finally, turning to FIG. 14, a table 50 is illustrated having pivotal legs 51, 52 which are mounted in support tubes 108, 109 and pivoted by means of axles 115. A cross brace, or similar (not illustrated) is used to maintain the legs 51, 52 in their erect position. The overall arrangements is analogous to that described in detail in relation to FIGS. 1–13.

In addition, in the event of damage due to wear, natural environmental factors or deliberate or accidental damage, repair and replacement costs are minimized by the assembly technique. Also minimized is wear on the pivot axle 15 since it can be firmly held stationary.

The foregoing describes only two embodiments of the present invention and modifications, obviously those skilled in the art, can be made thereto without departing from the scope of the present invention.

For example, although two tracks 38 are illustrated and preferred to give extra strength, only a single track 38 (the one further from the side cap 28) is necessary. Under these circumstances the side flap 28 itself can also be removed. Similarly, although the tubes 8, 9 are illustrated as being square, the tube can also be rectangular or round (i.e. conventional pipe of annular cross-section). The cross-sectional shape of the plug 17 then needs to be correspondingly varied.

The term "comprising" as used herein (and its grammatical variants) is used in the inclusive sense of "including" or "having" and not in the exclusive sense of "consisting only of".

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. An axle mount arrangement for furniture, said arrangement comprising a receptacle having at least one side wall, having a rim, at least one curved track formed in said side wall and commencing at said rim, said track being dimensioned to receive the axle to be mounted, and a plug dimensioned to be received in said receptacle, said plug having an axle receiving aperture therein shaped to define a first and a second axle niche which are spaced apart by a distance corresponding to an displacement of said curved track, whereby said axle can be positioned in said first axle niche and said plug introduced into said receptacle to thereby align said axle and a start of said curved track, and whereby as said plug is fully inserted into said receptacle said axle moves along said track from said first to said second niche, and is held in said second niche by interengagement of said plug and receptacle.

2. The arrangement as claimed in claim 1 wherein said plug is dual handed and includes a third axle niche displaced from said first axle niche and symmetrically arranged therewith with respect to said second axle niche, whereby said axle is movable from either said first or said third axle niche to said second axle niche.

3. The arrangement as claimed in claim 2 wherein said plug includes a retention means to releasably retain said axle in said first niche.

4. The arrangement as claimed in claim 3 wherein said retention means comprises a pivotable resilient member located intermediate said first and third axle niches and having a rest position from which it is pivotably displaceable by said axle being located in either said first or third niche.

5. The arrangement as claimed in claim 1 wherein said receptacle comprises one end of a hollow tube.

6. The arrangement as claimed in claim 5 wherein said tube has a substantially constant cross-sectional shape.

7. The arrangement as claimed in claim 6 wherein said tube shape is selected from the group consisting of square, rectangular and round.

8. The arrangement as claimed in claim 1 wherein said receptacle has a single said track.

9. The arrangement as claimed in claim 8 wherein said single track is substantially J-shaped.

10. The arrangement as claimed in claim 9 wherein each said track is substantially J-shaped.

11. The arrangement as claimed in claim 1 wherein said receptacle has a pair of said tracks which are located opposite each other.

12. The arrangement as claimed in claim 1 wherein said plug has a side flap which is not received in said receptacle and when said plug is fully inserted in said receptacle overlies said axle.

13. The arrangement as claimed in claim 1 wherein said plug has as a cap which abuts the rim of said receptacle when said plug is fully inserted therein.

* * * * *